United States Patent [19]

Peters

[11] 4,240,157

[45] Dec. 23, 1980

[54] SELF-SERVICE GASOLINE GLOVE

[75] Inventor: Russell E. Peters, Valparaiso, Ind.

[73] Assignee: James D. Coburn, Portage, Ind.

[21] Appl. No.: 861,960

[22] Filed: Dec. 19, 1977

[51] Int. Cl.[2] ..... A41D 19/00

[52] U.S. Cl. ..... 2/161 R; 2/167; 2/168

[58] Field of Search ..... 2/161 R, 162, 167, 168, 2/169

[56] References Cited

U.S. PATENT DOCUMENTS

| | | | |
|---|---|---|---|
| 1,346,683 | 7/1920 | Reynolds | 2/161 R |
| 2,378,773 | 6/1945 | Hurt | 2/162 |
| 2,710,971 | 6/1955 | Hall | 2/161 R |
| 3,789,555 | 2/1974 | Means | 2/167 |

FOREIGN PATENT DOCUMENTS

| | | | |
|---|---|---|---|
| 340184 | 9/1959 | Switzerland | 2/161 R |
| 801100 | 9/1958 | United Kingdom | 2/167 |

*Primary Examiner*—Louis Rimrodt

*Attorney, Agent, or Firm*—Marmaduke A. Hobbs

[57] ABSTRACT

A glove is provided for vehicle operators to use in self-service gasoline stations during the dispensing of gasoline into the tank of the vehicle. The glove is designed for use on either a left or a right hand and has a wide entry opening making it easy to insert and/or remove the hand of the user. Both front and back surfaces of the glove are treated to resist gasoline. A clip is provided for securing the glove to a license plate or in a compartment during nonuse.

7 Claims, 5 Drawing Figures

SELF-SERVICE GASOLINE GLOVE

BACKGROUND OF THE INVENTION

1. Field of the Invention

This invention relates to hand gloves and, more particularly, to a glove for use during the dispensing of gasoline into a vehicle.

2. Description of the Prior Art

With the recent advent of self-service gasoline stations and the fact that in many states the operation of such stations is now legal, a problem has arisen which is both annoying and potentially dangerous. That is, in handling the gasoline nozzle, it is not uncommon for the operator to get gasoline onto his or her hand and, depending upon the amount of gasoline, the fumes therefrom in the vehicle can become a fire hazard, particularly if the operator attempts to light a cigarette or the like. In addition, the odor of gasoline on the hand stays for a considerable period of time and is even difficult to wash off.

Normal cloth or leather gloves are as bad as or worse than no gloves at all, in that they absorb the gasoline and carry the odor and/or the volatile effect therewith.

SUMMARY OF THE INVENTION

I have devised an improved gasoline glove which can be worn either on the left or the right hand and is specially treated so as to resist absorbing gasoline and the like. The glove has a coating of material which resists gasoline, said coating being disposed on the two faces of the glove and around the enlarged opening into the glove. The material serves to hold the opening open for ready access into and exit from the glove. A clip or magnet is provided on the edge of the opening into the glove for securing the glove to a part of the vehicle, such as the rear of the license plate or the inside of the compartment door containing the gasoline filler tube. Wearing the glove while dispensing the gasoline will prevent the hand of the operator from becoming permeated with the gasoline, and upon completion of the dispensing operation, the glove can be secured to said part of the vehicle for airing, drying and proper positioning, ready for the next use of the glove.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 3:
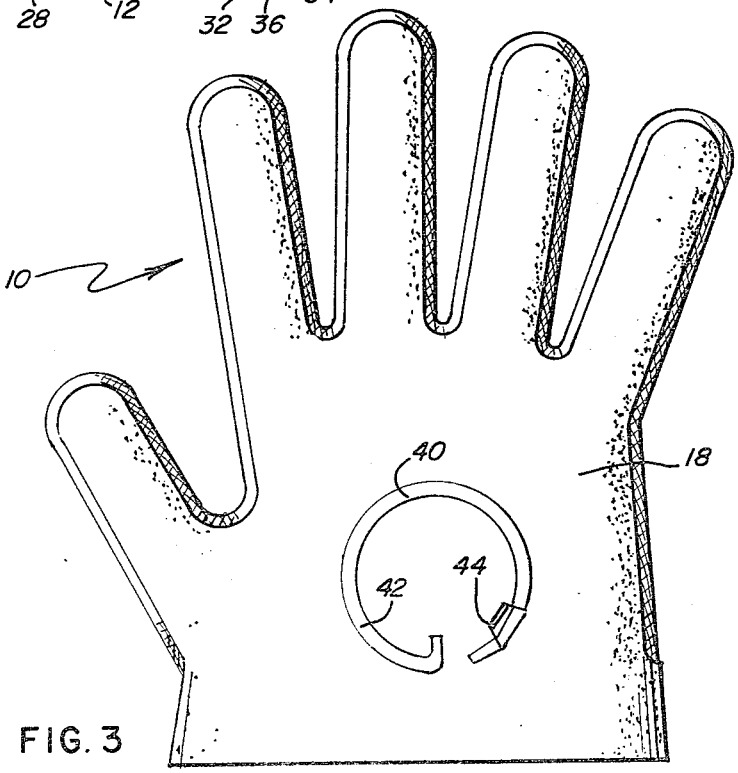
FIG. 3 is an elevational view of the other face of the glove opposite from the face of FIG. 1.

Referring to the drawings, an improved self-service right or left hand gasoline glove hand protector 10 is illustrated and has one face 12, with the usual four fingers 14 and a thumb 16. As viewed in FIG. 1, the face 12 is the palm of the glove when used by the right hand of a user. FIG. 3 illustrates the face 18 of the glove which is on the opposite side of the glove from face 12. Face 18 would be the palm of the glove when the glove is worn on the left hand of a user.

Figure 2:
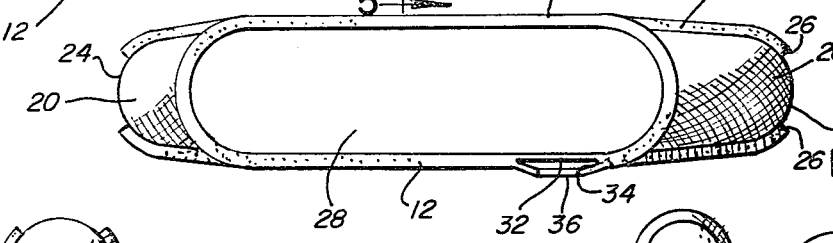
FIG. 2 is an end view looking in the open end of the glove of FIG. 1.
Figure 4:
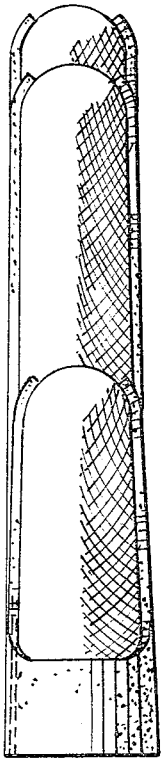
FIG. 4 is an end view of the glove looking in the direction of the thumb; and, FIG. 5 is a cross-sectional view taken along the lines 5—5 of FIG. 1.

The glove has a base portion 20 made up primarily of a canvas or a cloth, both of which should be treated with a gasoline-repellent material. To the base portion 20 is bonded, coated or the like, a layer of neoprene material 22 which covers most of the face 12 and face 18, leaving only the side edges 24 of the fingers and thumb uncoated. The neoprene coating 22 takes the same outward configuration as the outline of the glove, but the edges 26 of the coating are spaced slightly inward from the edges 24 of the fingers and thumb so that the canvas or gasoline-repellent cloth forms the side edges 24 of the fingers 14 and thumb 16 and the neoprene coating 22 forms the faces 12 and 18 of the glove. The hand opening 28 into the glove is relatively large and cuts across the fat portion of the palm of a hand near the junction of the hand with the wrist. The opening 28 is held in an oval open configuration, such as shown in FIG. 2, by means of the coating of neoprene material 22 being formed completely around the opening 28 and in a lip 30 down, slightly inside the edge of the opening to form a cuff. The cuff of neoprene coating 22 acts as a stiffener with the canvas or cloth material to hold the opening 28 open.

Formed on one face 12 of the glove is a slot 32 which has undercut edges 34 opening from the open end of the glove. A spring clip 36 is inserted in the slot 32 and is secured therein, as by gluing or the like, with the spring-urged free end 38 of the clip bearing against the face 12 of the glove. As a modification, it is possible to use a magnet in the slot 32, which, like the spring clip 36, would serve to hold the glove against a metal surface when not in use.

Figure 1:
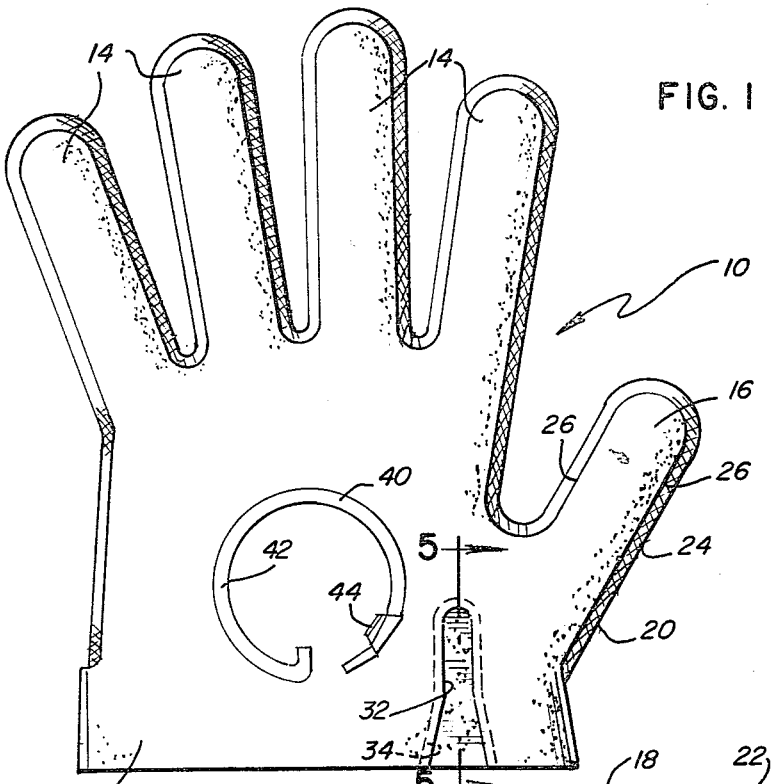
FIG. 1 is an elevational view of one face of my improved self-service gasoline glove.
Figure 5:
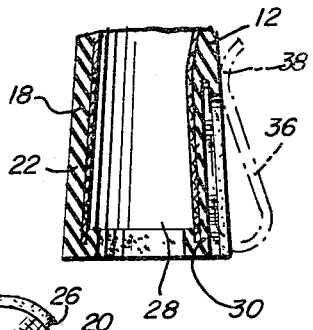

In FIG. 3, the other face 18 of the glove is viewed and it will be noted that it is the exact opposite of the face 12 of FIG. 1 and has the same configuration of the neoprene coating 22 as the side 12. As viewed in FIG. 3, the glove is for left-hand use with the face 18 serving as the palm of the glove and the face 12 now serving as the back of the glove. Once again, in FIG. 3 it can be seen that the neoprene material completely surrounds the opening 28 into the glove so as to provide the cuff for stiffening the walls of the opening as referred to above.

For decorative purposes, a logo 40 can be molded into the neoprene material on the face 12 or on the face 18, or on neither face, as the case may be. As shown, the logo 40 is in the form of a circular gasoline hose 42 with a hose nozzle 44 on one end portion thereof.

The glove can be supplied in two sizes, large and small, for men and women, respectively. The neoprene material can be decorated with flowers to designate a woman's glove or it can be stained brown, or the like, for men.

In use, the clip 36 on the glove can be affixed to a license plate with the glove positioned behind the license plate. It is intended that when it is desired to use the glove, the operator will run his hand into the enlarged open end 28 of the glove and then, by slightly bending the palm of the hand, he will be able to move the hand and the glove relative to the license plate to unclip the clip 36 from the license plate. The gloved hand is then used to grip the nozzle of the gasoline pump for putting the gasoline nozzle into the filler tube of the gas tank and for dispensing the desired amount of gasoline. When the tank is full or the desired amount of gasoline is dispensed, the nozzle is shut off and is placed on the pump. The gloved hand can then be used to replace the cap on the filler tube, whereupon the glove 10, with the hand still in it, is aligned with the license plate so that the clip 36 on the glove will engage with the edge of the license plate. Once the glove is securely clipped to the license plate, the hand is removed from the glove and the operator is free to return to the cab of the vehicle for further driving.

The neoprene and canvas material prevent gasoline from getting on the hand of the operator since the neoprene and canvas will repel the gasoline. In this way, there are no gasoline odors or actual gasoline on the hand of the operator, to present a safety hazard and the annoyance of the odor of gasoline in the vehicle.

The glove can be decorated in many ways, including red, white and blue stripes, and the like. It is contemplated that the gloves will be sold through gasoline stations whereby one glove can serve both left or right hand use. Under certain circumstances, the operator of the gasoline station may stock only one size glove, which glove will serve both for left and right hand use and for male and female customers.

I claim:

1. An interchangeable right or left hand glove for self-service gasoline dispensing, comprising a body of gasoline resistant canvas material having one face on one side, another face on the other side and side edges joining said faces, each face having a palm section, four fingers and a thumb, all of which are joined together by the side edges to form said glove body, said thumb extending laterally from one side of the palm sections, a layer of neoprene on each face of said body with the neoprene extending to and completely surrounding an opening into one end of the glove body to hold the end of said glove in open position, and fastening means secured to one side of the glove in close proximity to said open end and serving to attach the glove to a fixed object, such as the license plate on a vehicle, for inserting and removing the right or left hand without the assistance of the other hand.

2. A self-service gasoline glove as claimed in claim 1 wherein said fastening means is a spring clip having an extended portion resiliently urged toward one face of the glove whereby a fixed object can be trapped between the clip and the face to hold the glove to said fixed object.

3. A self-service gasoline glove as claimed in claim 1 wherein said fastening means is a magnet.

4. In an interchangeable right and left hand glove for use in dispensing gasoline, a body having opposite faces with palm sections thereon and a thumb extending laterally from said palm section, a gasoline resistant material joining said faces, a coating of neoprene material covering each face of said glove body, said coating forming a cuff substantially around an opening into said body in the space between said faces for holding the opening into the glove body in an open position, and fastening means secured to one side of the glove in close proximity to said open end and serving to attach the glove to a fixed object, such as the license plate on a vehicle, for inserting and removing the right or left hand without the assistance of the other hand.

5. A glove as claimed in claim 4 wherein said gasoline resistant material is a treated canvas.

6. A glove as claimed in claim 4 wherein said fastening means is a spring clip.

7. A glove as claimed in claim 4 wherein said fastening means is a magnet.

* * * * *